US007607193B1

(12) United States Patent
Franklin

(10) Patent No.: US 7,607,193 B1
(45) Date of Patent: Oct. 27, 2009

(54) COMBINATION TICKET SCRATCHING DEVICE AND MONEY CLIP

(76) Inventor: Steven D. Franklin, 6440 Larry Way, North Highlands, CA (US) 95660

( * ) Notice: Subject to any disclaimer, the term of this patent is extended or adjusted under 35 U.S.C. 154(b) by 8 days.

(21) Appl. No.: 11/851,211

(22) Filed: Sep. 6, 2007

(51) Int. Cl.
*A47L 13/02* (2006.01)

(52) U.S. Cl. ..... 15/236.01; 15/236.05; 30/169

(58) Field of Classification Search ..... 15/236.01, 15/236.02, 236.05, 236.06, 236.08, 236.09; 30/169
See application file for complete search history.

(56) References Cited

U.S. PATENT DOCUMENTS

| | | | | | |
|---|---|---|---|---|---|
| 520,818 | A * | 6/1894 | Bettinger | ..... | 30/91.2 |
| 3,670,414 | A * | 6/1972 | Stecker | ..... | 30/338 |
| 4,646,382 | A * | 3/1987 | Smith | ..... | 15/236.01 |
| D290,056 | S * | 5/1987 | Hatfield | ..... | D32/46 |
| 4,793,061 | A | 12/1988 | Rizzo | | |
| 4,881,291 | A * | 11/1989 | Ellis | ..... | 15/236.01 |
| 5,143,371 | A * | 9/1992 | Strahan | ..... | 473/285 |
| 5,419,004 | A | 5/1995 | Fox | | |
| 5,586,357 | A * | 12/1996 | Kosakowski et al. | ..... | 15/111 |
| 5,907,882 | A | 6/1999 | Tyree | | |
| 6,158,493 | A * | 12/2000 | Hildebrand et al. | ..... | 156/584 |
| 6,470,574 | B1 * | 10/2002 | Strumke, Jr. | ..... | 30/169 |

* cited by examiner

*Primary Examiner*—Randall Chin
(74) *Attorney, Agent, or Firm*—Costello Law Corp.; John P. Costello

(57) ABSTRACT

An inventive device for removing the concealing coating on a gaming ticket is disclosed. The device is comprised of a top member and a bottom member, which join at an arcuate end, forming a flexible jaw-like structure. The top member joins to a downward-depending member having a scraping surface at its terminus. In use, a gaming ticket is inserted into the jaw-like structure and the top and bottom members are squeezed together to bring the scraping surface to bear against the concealing coating on the face of the ticket. As the ticket is pulled free of the jaw, the concealing coating is gradually peeled free from the face of the ticket by the scraping edge, thereby exposing the prize indicia located on the ticket face.

9 Claims, 1 Drawing Sheet

COMBINATION TICKET SCRATCHING DEVICE AND MONEY CLIP

TECHNICAL FIELD

The present invention pertains to devices for scratching the face of gaming tickets in order to remove a waxy or otherwise concealing coating, which conceals the prize indicia located on the face of a ticket.

BACKGROUND

A variety of small devices for scratching the face of a gaming ticket have evolved over the course of time. Many of these devices have adopted a box-like configuration, which have a scraping edge for scraping a gaming ticket and an enclosed portion for catching the scrapings from a ticket. An exemplary ticket scratcher of this type is shown in U.S. Pat. No. 4,793,061, (issued to Rizzo), which discloses a device having a thick, plastic, box-like body with a slot that penetrates the body. A cantilever member having a scraping edge resides at the entry of the slot so that when a ticket is inserted into the slot the cantilever member is depressed against the face of the ticket, as it is pulled past the cantilever member, which removes the concealing coating from the ticket. Other similar ticket scratching devices include those seen in U.S. Pat. Nos. 5,907,882 (issued to Tyree) and 5,419,004, (issued to Fox), which incorporate variations of a box having a slot for inserting one or more lottery tickets. These additional devices incorporate various mechanical means to bring a scraping edge into contact with the face of a ticket.

The previously mentioned devices, while possibly being effective for removing a good portion of the concealing coating of a ticket, all operate on the design of a box having a slot which requires the ticket to be maneuvered into the slot, which can be difficult if a ticket is bent or torn. Also, the enclosed quality of the box-like design encloses the coating scrapings, which requires the user to repeatedly bother with opening the box to empty the scrapings. Additionally, if a ticket is not fully scratched after a first pass through the box, the user must pass the ticket blindly through the box, sometimes multiple times, without fully knowing if the un-scraped area is being attended to on each pass. Finally, the singular ticket scratching function provided by these devices reduces the chance that they would be carried by a user on a regular basis and therefore it is unlikely a user would have these devices available when a ticket needed to be scratched.

The foregoing reflects the state of the art of which the inventor is aware, and is tendered with a view toward discharging the inventor's acknowledged duty of candor, which may be pertinent to the patentability of the present invention. It is respectfully stipulated, however, that the foregoing discussion does not teach or render obvious, singly or when considered in combination, the inventor's claimed invention.

SUMMARY OF THE INVENTION

The present invention is a device for removing the concealing coating which covers the prize indicia located on the face of a gaming ticket. The device is basically comprised of a top planar member and a bottom planar member, which are joined at an arcuate end to form a type of jaw having a flexible spring-like quality. The top member is joined to a downward-depending member, which terminates at a slight vertical distance above the bottom member, so as to leave a gap between the terminus of the downward-depending member and the bottom member. At its terminus, the downward-depending member incorporates a scraping edge (first scraping edge), which is offset at an angle. The front end of the bottom member also terminates in a scraping edge (second scraping edge) and is accomplished in the preferred embodiment by forming the front end into an acutely angled terminus.

In operation, a gaming ticket is inserted into the "jaw" of the device through the gap located between the first scraping edge and the bottom member. Preferably, one end of the ticket should remain free of the jaw for the user to grasp. When the user judges that an appropriate length of the ticket has been inserted for removing enough of the concealing coating so that the prize indicia can be read, the user pushes the top member and bottom member flexibly together. When the pressure on the members causes the gap to close the first scraping edge is put into contact with the top surface of the ticket. When enough pressure is applied on the two members to allow the scraping edge to remove the concealing coating, the user grasps the free end of the ticket and pulls it out of the jaw. As the ticket is pulled free of the jaw, the coating is scraped off, thereby revealing the prize indicia on the face of the ticket.

Should a portion of the concealing coating remain on the face of the ticket after application of the first scraping edge, the user can manually apply the second scraping edge to the face to remove any concealing coating, which may still hide the prize indicia. Also, for the convenience of the user, the device is preferably endowed with a key chain retainer so that the device can be attached to a user's key chain, thus enhancing the possibility that the inventive device will be carried regularly by a user. As a further enhancement to the device's functionality (and likelihood that it will be carried by the user), it can double as a money clip as the spring-like open-sided jaw of the device allows bills of currency to be positioned laterally and held within the jaw by spring force.

Accordingly, the following objects and advantages apply:

It is an object of this invention to provide a device for effectively removing the concealing coating located on the surface of a gaming ticket or any ticket where a concealing coating is applied.

It is a further object of this invention to provide a device for removing the concealing coating on a gaming ticket which can be easily and cheaply manufactured.

It is still a further object of this invention to provide a device for removing the concealing coating on a gaming ticket which can be attached to a key chain.

Another object of this invention is to provide a practical multi-functional tool which will increase the likelihood that his device will be carried by a user.

Further objects and advantages of the invention will be brought out in the following portions of the specification, wherein the detailed description is for the purpose of fully disclosing preferred embodiments of the invention, without placing limitations thereon.

BRIEF DESCRIPTION OF THE DRAWINGS

The invention will be more fully understood by reference to the following drawings, which are for illustrative purposes only.

DETAILED DESCRIPTION OF THE PREFERRED EMBODIMENTS

Figure 1:
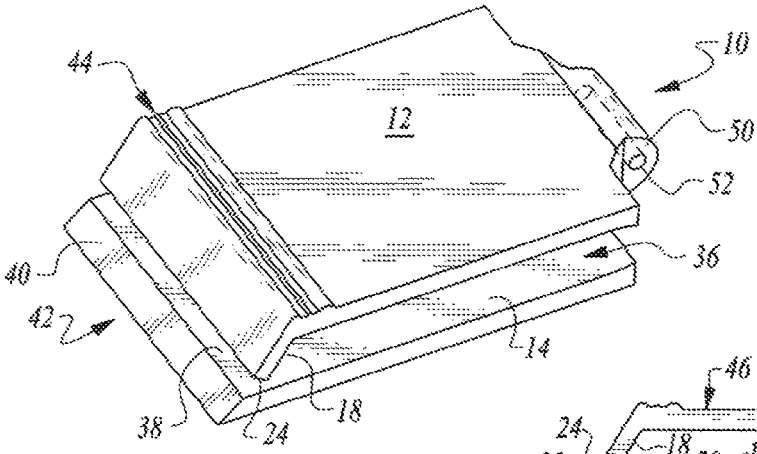
FIG. 1 is an elevated perspective view of the inventive device.

Referring to FIG. 1, the preferred embodiment of an inventive device 10 is shown. The device is jaw-like in its construction and is designed to close in a jaw-like manner, to provide scraping pressure to the indicia-bearing face of a gaming ticket. The device 10 is comprised of a planar top member 12 and a planar bottom member 14 arranged in a parallel relation to each other and separated by a vertical distance. The top and bottom members 12, 14 joinedly converge at an arcuate end 16. The device 10 is preferably made of semi-rigid plastic material, which can be easily molded and shaped. Combining the arcuate end 16 with the semi-rigid plastic construction imparts a spring-like quality to the device 10; so that when the jaw is squeezed shut (e.g. when pressure is applied to the top and bottom members 12, 14) the inventive device 10 will spring back into its resting shape, shown in FIG. 1, upon releasing the squeezing pressure.

Figure 2:
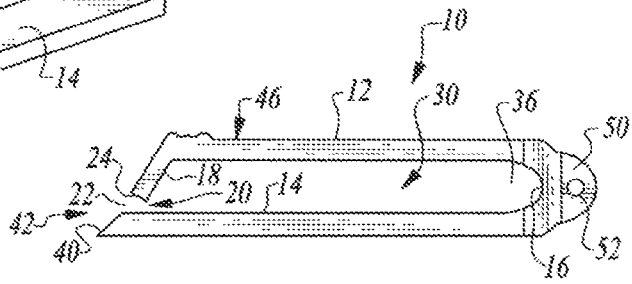
FIG. 2 is a side view of the inventive device.
Figure 4:
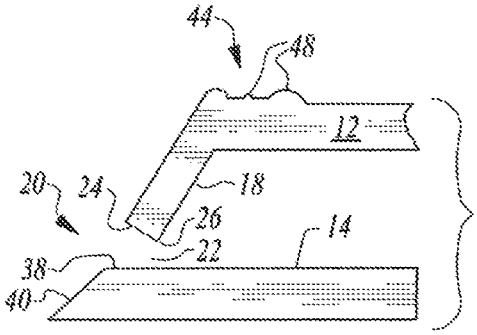
FIG. 4 is a close up side view of the scraping edges which is representative of one embodiment of the invention.
Figure 3:
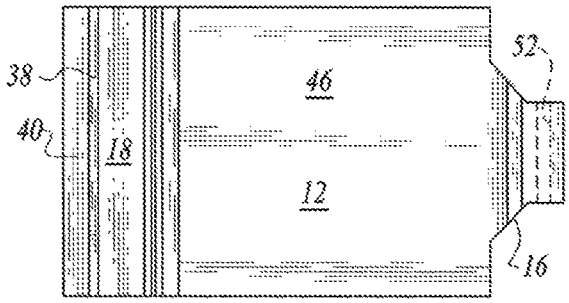
FIG. 3 is a top plan view of the inventive device.

Referring also to both FIGS. 2 and FIG. 3, it is shown how top member 12 joins with a downward-depending member 18, which has a terminus 20 positioned slightly above the bottom member 14. A vertical gap 22 remains between bottom member 14 and the terminus 20 of downward-depending member 18, this gap 22 being wide enough to accommodate the width of a gaming ticket. The terminus 20 also comprises a first scraping edge 24 for scraping the concealing coating from the face of a gaming ticket. The first scraping edge 24 is preferably slightly wider than the width of a gaming ticket so as to insure that the entire surface of the ticket receives contact, and is thereby scraped clear of any concealing coating. FIG. 4 shows a close up view of the first scraping edge 24.

The scraping edge 24 is positioned longitudinally forward of the top member 12. To achieve the forward positioning of the first scraping edge 24, the downward-depending member 18 and top member 12 are joined in an obtusely angled orientation, which positions the first scraping edge perfectly for providing scraping force to the face of a ticket. The obtusely angled orientation of the top member 12 to the downward-depending member 18 places the first scraping edge 24 at an offset orientation from level, slightly forward of top member 12, such that corner 26 of first scraping edge is brought into contact with the face of a gaming ticket when the top and bottom members 12, 14 are squeezed together. The semi-rigid plastic material comprising the device 10 provides enough rigidity so that when the ticket is pulled past the first scraping edge 24 at gently squeezing pressure, the downward-depending member 18 is not carried forward to the breaking point by the force of the passing ticket. In use, applying gentle squeezing pressure to the top and bottom members 12, 14 is sufficient to remove the concealing coating from a ticket, without over-stressing its parts.

Figure 5:
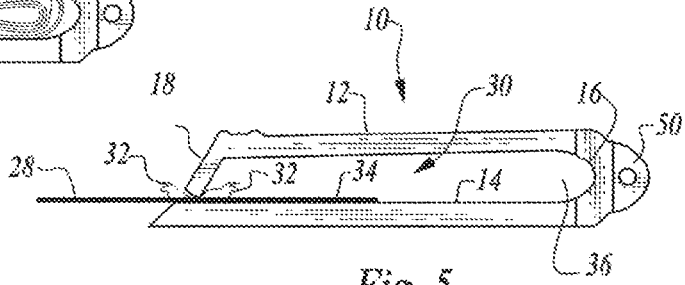
FIG. 5 is a side view of the inventive device shown with a gaming ticket squeezed between the first scraping edge and the bottom member and having its concealing coating removed.

FIG. 5 shows the device 10 in use being applied to a gaming ticket 28. From the side, the area bordered by the top and bottom members 12, 14, the downward-depending member 18 and the arcuate end 16, comprise a recess 30 with open sides 36. As a coating 32 is scraped from a ticket face 34 by the first scraping edge 24, it fills the recess 30, and can be shaken out of the open sides 36 by the user. As shown, the user positions the ticket 28 on the bottom member 14 and squeezes the top and bottom members 12, 14 together, thus bringing the first scraping edge 24 into contact with the coated face 34 of the ticket 28. The user should keep enough of the ticket 28 forward of the device 10 so that the can grasp it and pull it past the first scraping edge 24. The recess 30 allows the ticket to be viewed by the user as the scraping operation proceeds, thereby allowing the user to adjust the position of the ticket to achieve maximum scraping effectiveness.

Positioned longitudinally forward of the first scraping edge 24 is a shelf portion 38 of bottom member 14 and a second scraping edge 40. The second scraping edge 40 comprises the terminus of bottom member 14. The shelf portion 38 insures that if downward-depending member 18 is pulled forward slightly by the force of a passing ticket 34, that the first scraping edge 24 will still remain in contact with bottom member 14 and continue its scraping function. The second scraping edge 40 is preferably comprised of an acutely angled terminus 42 of bottom member 14. Upon application of first scraping edge 24 to the ticket 28 as shown in FIG. 5, the user may remove the ticket 28 from the recess 30 and remove any remaining concealed portion on the face 34 of the ticket 28 by manually applying second scraping edge 40 to the ticket face 34. Additionally, the second scraping edge 40 allows the inventive device to be used as a very adequate scraper for removing snow and ice from a car's windshield.

Still referring to the drawings, the inventive ticket scratching device 10 may also include a gripping portion 44 on the top surface 46 of the top member 12. The gripping portion is preferably placed at the end of the top surface of the top member, which allows for the comfortable placement of the user's thumb while applying downward pressure on the top member. This gripping portion 44 may further comprise a plurality of latitudinally disposed ridges 48 that would prevent finger slippage upon applying squeezing pressure to the top member 12.

Additionally, as an added feature of utility, the inventive device 10 may incorporate a key chain retainer 50 which extends longitudinally rearward of the arcuate end 16. The key chain retainer 50 has an aperture 52 for attaching to a key chain, the aperture 52 extending latitudinally (shown by dotted lines) through the body of the key chain retainer 50 as shown.

Figure 6:
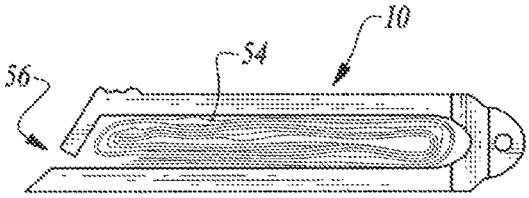
FIG. 6 is an elevated perspective view of the inventive device shown being used as a money clip.

A further functional advantage of the invention 10 is that it can operate as a money clip. Referring to FIG. 6, the inventive device 10 is shown with bills of currency 54 positioned laterally within the recess 30 of the device 10. When the recess 30 is filled with a certain thickness of bills 54, the spring action of the jaw-like device pushes the bills together within the recess 30 and holds them fast within the recess. The downward-depending member 18 further serves to block the forward travel of the bills 54, thereby preventing them from being pushed out of the front end 56 of the device 10.

Figure 7:
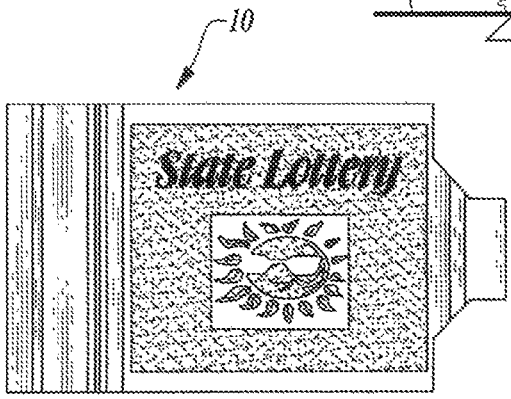
FIG. 7 is a top plan view of the inventive device being used as a promotional item.

FIG. 7 illustrates the device being used as an advertising accessory. The top surface 46 of top member 12 may also have an area for placing advertising indicia. This feature enhances the desirability of the present invention as a promotional item, along with its other utilitarian features.

Finally, although the description above contains much specificity, these should not be construed as limiting the scope of the invention but as merely providing illustrations of some of the presently preferred embodiments of this invention.

The invention claimed is:

1. A device for removing the concealing coating on a gaming ticket, the device comprising:

a top planar member and a bottom planar member, said top and bottom planar members being arranged in parallel relation and being separated by a vertical distance, said top and bottom planar members being joined at an arcuate end, said arcuate end flexibly imparting a spring-like action to said top and bottom planar members, said top planar member terminating at an end opposite said arcuate end wherein said opposite end is joined to a downward-depending member in an obtusely angled orientation; said downward-depending member forming a first offset scraping edge at its downward-most extent, said first scraping edge extends a longitudinal distance forward of said top member, said first scraping edge being separated by a vertical gap from said bottom planar member, wherein the convergence of said top and bottom planar members, said arcuate end and said downward-depending member form a recess having open sides, said recess allowing a gaming ticket placed on said bottom member to be viewed as it is placed in contact with said first scraping edge.

2. The device as recited in claim 1, wherein said bottom planar member extends a longitudinal distance beyond said first scraping edge.

3. The device as recited in claim 2, wherein said bottom planar member terminates at an angled end opposite said arcuate end, said angled end forming a second scraping edge.

4. The device as recited in claim 3, further comprising a key chain retainer, said retainer extending longitudinally rearward of said arcuate end, said key chain retainer having an aperture extending laterally through the body of said key chain retainer.

5. The device as recited in claim 4, wherein said top member further comprises a gripping surface located on a top surface of said top member near said end of said top member.

6. The device as recited in claim 5, wherein said gripping surface is further comprised of a plurality of latitudinally-disposed ridges.

7. A device for removing the concealing coating on a gaming ticket, the device comprising:

a top planar member incorporating a plurality of latitudinally-disposed ridges on its top surface, said top surface further comprising an area of open space for placing advertising indicia;

a bottom planar member being arranged in parallel relation with said top planar member, said top planar member being separated a vertical distance from said bottom planar member;

said top and bottom planar members joinedly converging in an arcuate end, said arcuate end flexibly imparting a spring-like action to said top and bottom planar members;

said top planar member terminating at an end opposite said arcuate end wherein said opposite end is joined to a downward-depending member in an obtusely angled orientation, said downward-depending member forming a first offset scraping edge at its downward-most extent, said first scraping edge extends a longitudinal distance forward of said top member;

said first scraping edge lying in vertical separation from said bottom planar member to form a gap between said first scraping edge and bottom planar member, said bottom planar member extending a longitudinal distance beyond said first scraping edge, said bottom planar member terminating at an acutely angled end opposite said arcuate end, said acutely angled end forming a second scraping edge; and a key chain retainer, said retainer extending longitudinally rearward of said arcuate end, said key chain retainer having an aperture extending laterally through the body of said key chain retainer.

8. A device for removing the concealing coating on a gaming ticket, the device comprising:

a top planar member;

a bottom planar member being arranged in parallel relation with said top planar member, said top planar member being separated a vertical distance from said bottom planar member;

said top and bottom planar members joinedly converging in an arcuate end, said arcuate end flexibly imparting a spring-like action to said top and bottom planar members;

said top planar member terminating at an end opposite said arcuate end wherein said opposite end is joined to a downward-depending member, said downward-depending member forming a first scraping edge at its downward-most extent;

said junction of said downward-depending member and said top planar member forming an obtuse angle orienting said first scraping edge a longitudinal distance forward of said top planar member;

said first scraping edge lying in vertical separation from said bottom planar member to form a gap between said first scraping edge and bottom planar member, said bottom planar member extending a longitudinal distance beyond said first scraping edge, said bottom planar member terminating at an angled end opposite said arcuate end, said angled end forming a second scraping edge.

9. The device as recited in claim 8, further comprising a key chain retainer, said retainer extending longitudinally rearward of said arcuate end, said key chain retainer having an aperture extending laterally through the body of said key chain retainer.

* * * * *